US006105754A

United States Patent [19]

Farina et al.

[11] Patent Number: 6,105,754

[45] Date of Patent: Aug. 22, 2000

[54] TRANSFER FOR MACHINE TOOLS

[75] Inventors: Luciano Farina, Lecco; Marco Vergani, Seregno, both of Italy

[73] Assignee: Manzoni Preese S.p.A., Lecco, Italy

[21] Appl. No.: 08/969,678

[22] Filed: Nov. 13, 1997

[30] Foreign Application Priority Data

Nov. 15, 1996 [IT] Italy ..... MI96A2379

[51] Int. Cl.[7] ..... B65G 25/00

[52] U.S. Cl. ..... 198/774.2; 414/749.1

[58] Field of Search ..... 198/468.2, 468.3, 198/774.2, 775, 777; 414/749.1

[56] References Cited

U.S. PATENT DOCUMENTS

| | | | |
|---|---|---|---|
| 4,750,605 | 6/1988 | Brems et al. | 198/774.2 X |
| 5,829,571 | 11/1998 | Mizuta et al. | 414/749.1 X |
| 5,868,541 | 2/1999 | Tajima et al. | 198/774.2 X |

FOREIGN PATENT DOCUMENTS 195 06 079 8/1996 Germany .

OTHER PUBLICATIONS

Patent Abstracts of Japan, vol. 15, No. 190, May 16, 1991 & JP03047639A (Komatsu Ltd.).

*Primary Examiner*—Christopher P. Ellis
*Assistant Examiner*—Gene O. Crawford
*Attorney, Agent, or Firm*—Jacobson, Price, Holman & Stern, PLLC

[57] ABSTRACT

A transfer for machine tools, in particular presses, including a pair of parallel bars supporting the elements to be transferred and borne longitudinally sliding on supports. The supports are movable in a crosswise direction to the bars, to vary the distance between them, and in a direction at right angles to the plane containing the pairs of bars. The bars are made to move longitudinally by motors interposed between each bar and the corresponding support.

5 Claims, 2 Drawing Sheets

TRANSFER FOR MACHINE TOOLS

BACKGROUND OF THE INVENTION

Field of the Invention

This invention refers to transfer presses, and more in particular to the transfer mechanism associated with them. Transfers for presses are generally composed of a pair of parallel bars, onto which the elements for gripping the pieces to be transported are designed to be fitted. These elements can have the most diverse configurations, in relation to the processing to be carried out and the configurations of the pieces.

In these transfers, the pair of bars is guided in a longitudinal forward movement and must also be movable in a vertical direction. Moreover, the two bars must be provided with reciprocal movements to bring them close to and away from each other.

Hence, each bar is movable along three orthogonal axes.

More in particular, according to the commonly used conventional transfer structure, the bars are carried on supports which are made to move vertically, by means of a motorized control, on saddles capable of sliding horizontally, crosswise to the bars. The two saddles are made to move away from or close to each other by suitable motors, to define the distance between the bars. The bars are also movable longitudinally on the supports.

According to the known technique, the mechanism for the longitudinal movement of the bars comprises a stationary drive unit of various type, which draws the bars in their longitudinal movement through a kinematic coupling which engages the bars longitudinally only, allowing them to maintain their vertical and transversal freedom of movement.

This unit acts on the ends of the bars and causes a considerable obstruction in correspondence with the head of the transfer. Moreover, it is complicated and expensive to control the bars by means of a connection which leaves the bars two degrees of freedom of movement along the axes perpendicular to the longitudinal axis.

SUMMARY OF THE INVENTION

To obviate these problems, according to the invention a transfer for machine tools, in particular presses, comprises a pair of parallel bars for supporting the elements to be transferred and carried longitudinally sliding on supports, the supports being movable in a crosswise direction to the bars in order to vary the distance between them and in a direction perpendicular to the plane containing the pairs of bars, and is characterized by the fact that the bars are made to move longitudinally by motors interposed between each bar and the corresponding support.

BRIEF DESCRIPTION OF THE DRAWINGS

The technical solution identified by the invention will be more clearly evident from the following description of an exemplificative embodiment, schematically illustrated in the accompanying drawings, in which.

DETAILED DESCRIPTION OF THE INVENTION

Figure 1:
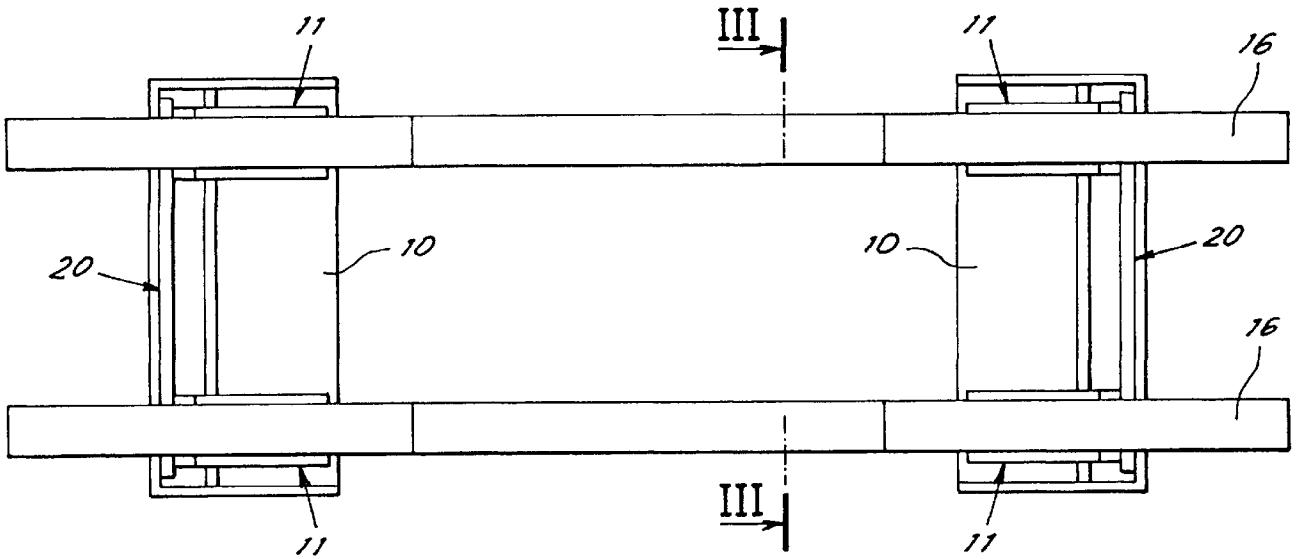
FIGS. 1 and 2 respectively show a plan view and a front elevational view of a transfer according to the invention.
Figure 2:
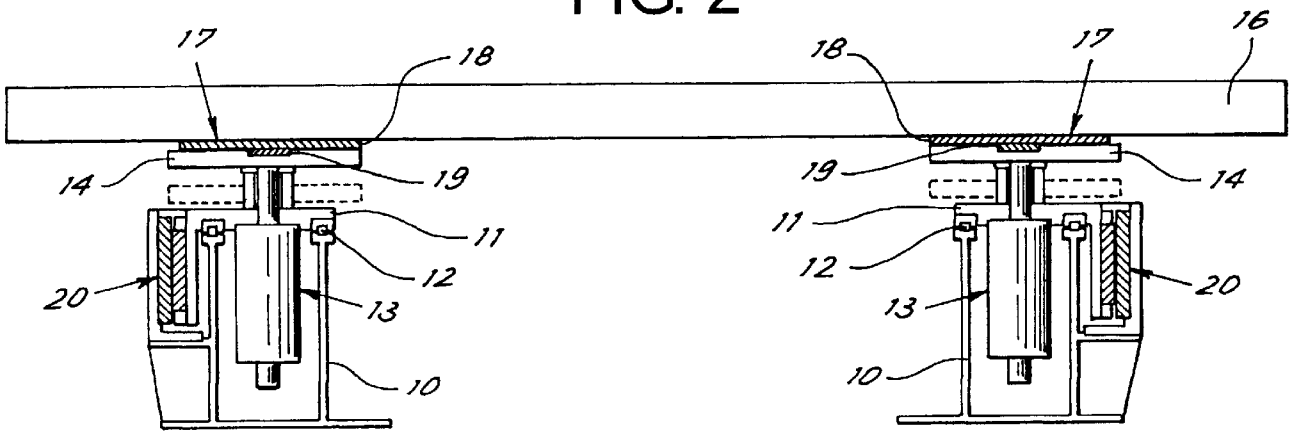
Figure 3A:
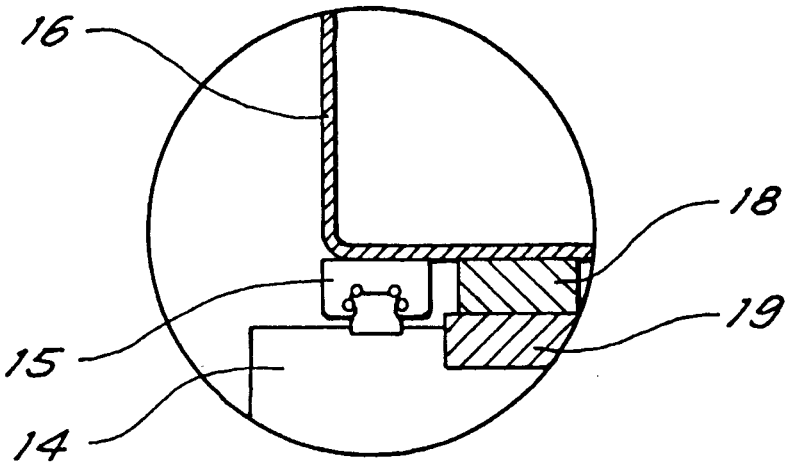
FIG. 3A shows an enlarged view of an area encircled in FIG. 3.
Figure 3:
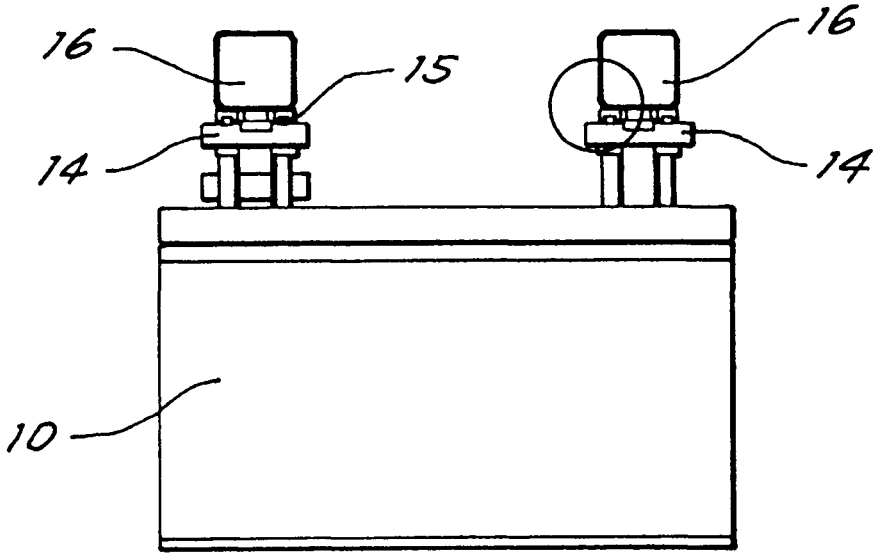
FIG. 3 shows an enlarged view of a section along the line III—III represented in FIG. 1.

The transfer is composed of two bedplates 10, equally spaced apart.

Mounted on each bedplate are two saddles 11, movable on linear bearings 12. Mounted on each saddle is an actuating element 13 which vertically moves a support 14, which is consequently provided with a horizontal and vertical movement. Carried on each support, by means of linear roller bearings 15 is a bar 16. Secured respectively to the bar 16 and to the support 14 are the two reciprocally movable parts 18, 19 of a linear electric motor generically indicated by reference 17. A linear motor 20, wholly similar to the motor 17, is interposed between each movable saddle 11 and the bedplate 10, to control the linear movement of the saddle in a crosswise direction to the bars 16.

For the movement of each support 14 in a vertical direction and in a horizontal direction perpendicular to the bars, actuators 13 and 20 respectively have been exemplified. However, these servomotor members for carrying out these movements, with their respective kinematic control mechanisms, can in any case be made according to the techniques traditionally used in these transfers, for the same purpose. An essential characteristic of the transfer according to the invention is to use the linear motor 17 interposed between supports 14 and bars 16 to effect the longitudinal stroke of the bar, thereby avoiding the conventional use of a pulling device acting on one of the ends of the bars by means of a connection which leaves the bars free to move vertically and towards each other.

According to the invention, the linear servomotor 17 for control of the longitudinal translation of the bars operates directly between the bar and the support that slidingly carries it, the movements according to the other two axes being carried out by the supports.

The actuator 13 can also be composed of a linear motor, like the servomotors 17 and 20, even though other known controls can be equivalently used, if necessary mechanically connected to the device that raises the other support fitted in correspondence with the same bedplate, for the coordinated movement of the two bars.

The linear motors can be chosen from among any suitable type capable of making the controlled elements go through those step-by-step movements typical of the type of transfer that the invention refers to. In the described embodiment, the linear motor is received between the guides for the longitudinal sliding of the bars. However, the motor may be disposed in any other suitable position between the support and the bar. For example, the supports 14 may have bases secured to them which are shaped in such a way as to receive one of the elements of the motor, the other element of the motor being secured directly to the bar or to a suitable base secured to the bar itself.

What is claimed is:

1. Transfer for machine tools, in particular presses, comprising a pair of parallel bars for supporting elements to be transferred and further comprising supports for the bars, the supports being movable in a crosswise direction to the bars to vary the distance between them and in a direction at right angles to the plane containing the pairs of bars, and linear motors interposed between each bar and the corresponding support to move the bars longitudinally.

2. Transfer as claimed in claim 1, wherein two reciprocally movable parts of the linear motor are secured directly to the bar and to the support respectively.

3. Transfer as claimed in claim 2, wherein the linear motor is received between linear guides for interconnection between the bar and the support.

4. Transfer as claimed in claim 1, wherein the support is guided to move in a direction perpendicular to the plane containing the bars, and a saddle on a bedplate is guided to move the bars in a crosswise direction to the bars.

5. Transfer as claimed in claim 4, wherein the movement of the support with respect to the bedplate is controlled by a linear motor.

* * * * *